United States Patent [19]

Alexander, Jr.

[11] Patent Number: 4,750,558

[45] Date of Patent: Jun. 14, 1988

[54] WELL BORE CLEANING TOOL

[76] Inventor: Granison T. Alexander, Jr., 2733 Comet St., New Orleans, La. 70114

[21] Appl. No.: 880,543

[22] Filed: Jun. 30, 1986

[51] Int. Cl.[4] ..... E21B 37/02

[52] U.S. Cl. ..... 166/173; 166/242

[58] Field of Search ..... 166/170–176, 166/241, 242, 311, 378, 380, 285, 286; 15/104.19, 104.16, 104.2, 104.09, 104.05

[56] References Cited

U.S. PATENT DOCUMENTS

| | | | |
|---|---|---|---|
| 2,634,813 | 4/1953 | Wright | 166/173 |
| 2,868,298 | 1/1959 | Gist | 166/173 |
| 2,868,299 | 1/1959 | Gist | 166/173 |
| 3,109,492 | 11/1963 | Solum et al. | 166/172 |
| 3,124,198 | 3/1964 | Solum et al. | 166/172 |
| 3,357,494 | 12/1967 | Bolding, Sr. | 166/173 |
| 3,390,725 | 7/1968 | Alexander, Jr. | 166/173 |
| 3,858,653 | 1/1975 | Turbyfill | 166/173 |
| 4,159,742 | 7/1979 | Alexander | 166/173 |

*Primary Examiner*—James A. Leppink
*Assistant Examiner*—Huang C. Dang
*Attorney, Agent, or Firm*—Keaty & Keaty

[57] ABSTRACT

A well bore cleaning tool comprises a plurality of collars which slip onto a pipe casing without welding, and can be securedly attached thereto using any conventional securing means, such as set screws. The collars are interconnected with a cable, disposed longitudinally on one side of the casing, substantially in a straight line. The well bore cleaning tool has utility in bore holes wherein there is a limited clearance or amount of space in the annulus (that is, the region between the exterior of the casing and the wall of the bore hole).

10 Claims, 1 Drawing Sheet

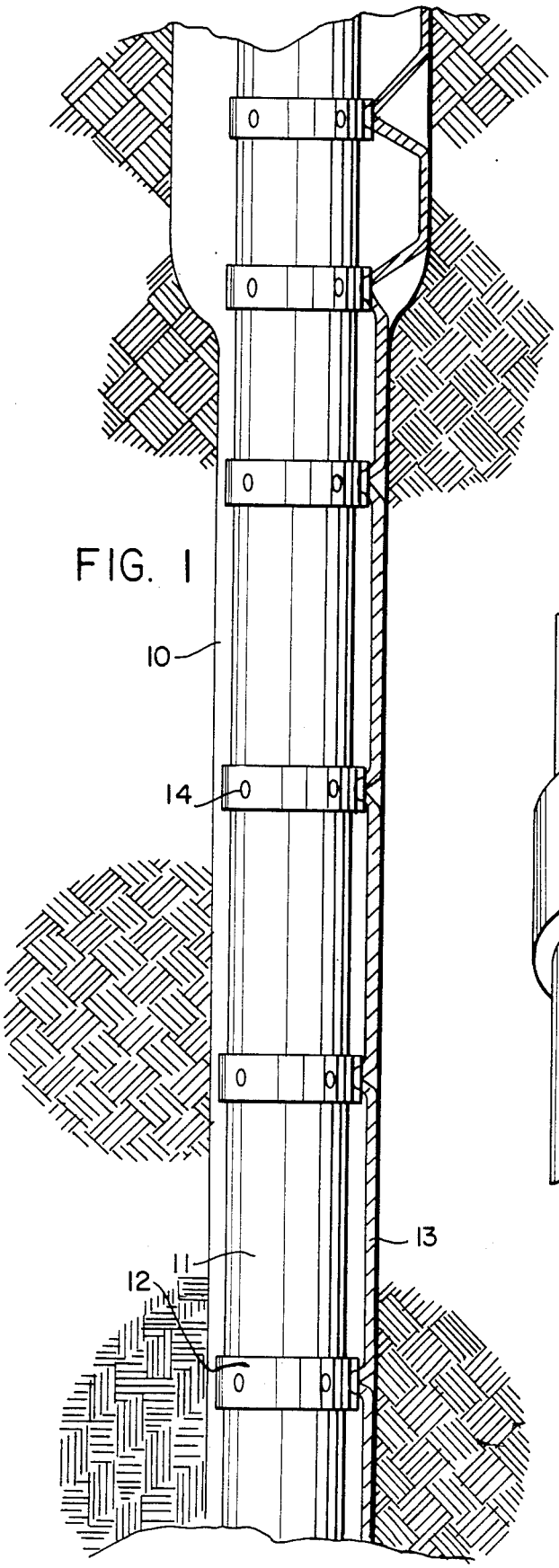
FIG. 1
FIG. 2
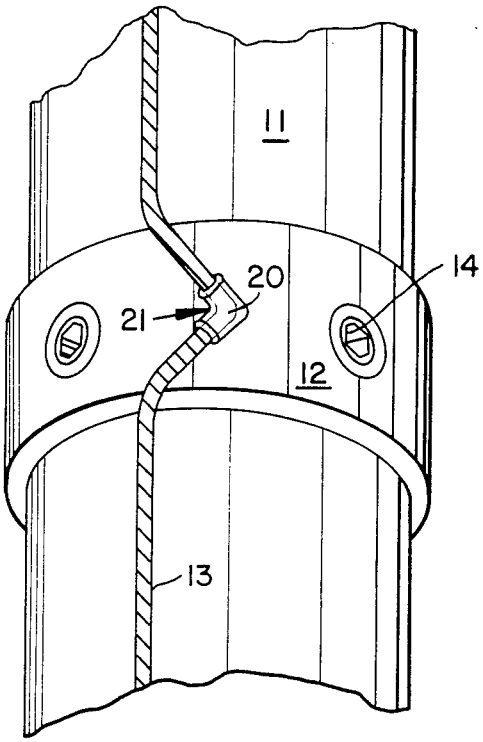

WELL BORE CLEANING TOOL

BACKGROUND OF THE INVENTION

1. Field of the Invention

The present invention relates to a well bore cleaning tool for attachment to a well casing or the like. More particularly, it concerns a well bore cleaning tool for cleaning the walls of a well bore where there is very limited space or distance between these walls and the well casing, often referred to as "close tolerance" conditions.

2. Background of the Invention

In the drilling and completion of an oil and/or gas well, there are three basic types of cementing operations necessary. The first, termed "casing cementing", is done to seal an annular space between the well casing and the bore hole so that fluids in permeable layers may not migrate vertically in the annulus. This procedure, also referred to as "primary" cementing, involves pumping a desired volume of cement slurry down the casing and back up the annular space a required distance toward the surface. "Channeling" or partial by-passing of the cement slurry past the drilling mud media in the well bore often results in primary cement jobs of poor quality, requiring secondary or "squeeze cementing" if the primary cementing of the casing was inadequate in sealing or supporting the casing string. This second type of cementing operation in well drilling and completion requires pumping of a cement slurry under very high pressure through holes which must be perforated through the casing at precise levels. It can reduce the oil or gas producing capability of a well due to filling the permeable section of the reservoir rock with drilling mud and cement. It is also very costly from the standpoint of the additional time and expense of the extra operations required. It has been demonstrated and documented in both laboratory testing and field operations that rotation of the casing, while cementing, is one of the most important factors in obtaining successful primary cement jobs consistently. The number and size of casing strings required for a well depends on its planned depth and the pressures anticipated at the various subsurface levels in the area. Typically, deeper wells require a number of concentric strings of casing to be run and cemented in progressively smaller hole sizes to line the newly drilled hole interval to contain the ever-increasing pressures which normally occur in deeper rock layers. For example, a bit which is used to start the well at the surface may be 26" in diameter to drill a 26" hole down to the first casing setting level, where a 20" O.D. casing is installed and cemented. The next bit would be 17½" in diameter to drill that size hole down to the next required level, where a 13⅜" O.D. casing is installed and cemented. The next bit would be 12¼" in diameter to drill down to the next critical level, where a 9⅝" O.D. casing is installed and cemented. The next bit size would be 8½" in diameter to drill the hole down to the next casing level, where a 7⅝" O.D. casing is run and cemented, usually as a "liner", which is defined as a short casing string which covers only the open hole interval plus a small overlap into the bottom of the previous casing to save the expense of running the entire length of the 7⅝" O.D. casing back to the surface. A 6½" bit is then used to drill that size hole below the 7⅝" casing liner down to the next critical level, where a 5½" O.D. casing could also be run as a "liner". If the objective zone has still not been reached, a 4⅝" bit is used to drill below the 5½" O.D. casing liner in preparation for a well completion in a still smaller casing size. From this example, it becomes evident that the annular space available between the bore hole and the casing or casing liner in deep wells is very limited and a cleaning tool which can be used safely to aid in the successful primary cementation of casing under such limited clearance conditions is greatly needed in the oil and gas industry to improve the quality of well completions while reducing their ultimate cost.

The setting of "cement plugs" is the third type of cementing operation sometimes required in drilling of oil and/or gas wells. It consists of filling up the drilled borehole over a specified vertical interval, usually ranging from a few hundred feet to a thousand feet or more in length, with cement to effect a "cement plug", for the purpose of abandoning a well found to be dry or depleted of oil or gas, or to change the direction of drilling to drill around a section of drill pipe or casing which may have become "stuck" and prevented deeper drilling, or to direct the drilling of the borehole in a different direction to a more favorable subsurface position to find the oil or gas reservoir. In setting "cement plugs", it is desirable to do so with pipe smaller than the drill pipe, since its removal, after the cement slurry has been pumped into place, does less to disrupt the ability of the cement to form a solid barrier in the borehole.

Whether cementing casing or setting "cement plugs", it is desirable for the walls of the well bore to be mechanically cleaned of the uncirculatable mud media, sometimes called "mud-cake", using abrading devices of cable or wire, known as "scratchers", to prevent contamination of the cement slurry by the chemically treated drilling mud and permit better bonding of the cement to the cleaned bore hole.

One common type of well bore cleaner is one which comprises cable and collars, the collars fitting on a pipe casing, and a cable or cables connected between the collars. The collars are securely attached to the casing, such as by welding or using set screws. Once the collars are attached to the pipe casing, the pipe casing is inserted into the well bore and, depending upon the particular arrangement of the collars and cables, the pipe casing is either rotated or reciprocated (or both), during which process the cables frictionally contact the well bore walls and loosen up the mud cakes; at the same time, cement is pumped through the bottom end of the casing upward and displaces the drilling mud and the mud cakes, which are loosened by the well bore cleaners, from the annulus. In some cases, wire is tied or otherwise attached to the cables in order to aid in cleaning the bore walls, as can be seen in U.S. Pat. Nos. 2,868,298 and 2,868,299. The well bore cleaning tools disclosed in these patents comprise, as do all well bore hole cleaning tools comprising cables and collars with which the applicant is aware, either a plurality of cables, or a single cable which is twisted around the casing to form a helix.

The limitation of previous rotating type cleaning devices, known to the applicant as "scratchers", has been that their cleaning fingers or loops are mounted on longitudinal metal strips, usually five feet long. These have certain disadvantages when used in close tolerance annular conditions encountered in deeper wells; their installation without welding requires separate stop devices, the combination of which protrudes from the casing surface too far to be safely used; the protruding devices may contact a ledge and any minor slippage of one stop device will cause the longitudinal base strip to buckle or break off and jeopardize lowering the casing or liner further to the desired setting depth. Additionally, the void space under the longitudinal strip, between it and the casing surface, is difficult, if not possible, to fill with cement, leaving a new area in the annulus for undesirable vertical fluid migration.

The scratcher shown in the applicant's U.S. Pat. No. 4,159,742 cleans by either reciprocation or rotation of the pipe, but its design is for setting cement plugs using smaller diameter pipe (then the drill pipe) where annular tolerances are not close, plus its 360 degree wall abrading design could be detrimental when lowering the casing in a deep close tolerance hole where there is a delicate mud balance between losing mud (to formations) and having one or more of the uncased permeable zones in the well trying to flow.

For the above reasons, the cleaning tools known to the applicant cannot be used as safely or effectively in close tolerance annular conditions as the well bore cleaning tool of the present invention.

SUMMARY OF THE INVENTION

The present invention overcomes the above mentioned disadvantages in a bore hole wherein there is a limited clearance or amount of space in the annulus.

The present invention is a well bore cleaning tool which comprises a plurality of collars which slip onto a pipe casing without welding, and can be securely attached thereto using any conventional securing means, such as set screws, and a cable which is disposed longitudinally on one side of the casing, substantially in a straight line. The well bore cleaning tool of the present invention can be used in bore holes wherein the annulus is so small that it was impossible to successfully clean it with the devices known before to the applicant. Once inserted into the bore hole, the casing is rotated, causing the cable segments to frictionally contact the walls of the bore hole, thereby abrading and loosening the mud cake which accumulates on the walls of the hole, allowing same to flow with the rest of the drilling mud, resulting in good sealing contact between the cement and the newly cleaned bore hole walls.

The well bore cleaning tool of the present invention is adjustable. On sections of the casing which correspond to levels in the bore hole where the bore hole is of a relatively larger diameter due, for example, to a brittle or caving formation, the collars can be placed closer together such that when the casing is rotated, the cable segments will extend further from the casing in order that they may be able to frictionally contact the walls of the bore hole.

It is therefore an object of this invention to provide a close tolerance well bore cleaning tool that can be safely used in very close tolerance conditions as encountered in deeper wells where there is limited space between the casing and the wall of the well bore.

Another object of the invention is to provide such a tool that can be easily attached to a casing, without welding.

Still another object is to provide a cleaning tool that can be adapted to bore holes having varying inside diameters, which will effectively abrade and remove uncirculatable mud-cake when the casing is rotated.

BRIEF DESCRIPTION OF THE DRAWINGS

For a further understanding of the nature, advantages, and objects of the present invention, reference should be had to the following detailed description taken in conjunction with the accompanying drawings in which like parts are given like reference numerals and wherein:

FIG. 1 is a schematic illustration of a well bore cleaning tool of the present invention attached to a pipe casing and inserted into a bore hole.

FIG. 2 is a detailed view of the collar and a means to attach the cable to the collar in accordance with the present invention.

DETAILED DESCRIPTION OF THE PREFERRED EMBODIMENT

Referring now to FIG. 1, the well bore cleaning tool of the present invention is shown to be mounted on a casing 11 within a well bore 10. The cleaning tool comprises a plurality of collars 12 to which a cable 13 is secured. The collars are slipped onto the casing 11 and are attached thereto. The casing 11 is then inserted into the bore hole 10. There is usually, in practice, only $\frac{1}{2}''$ to $\frac{3}{4}''$ clearance between the walls of the bore hole 10 and the surface of casing 11. It is in this very close area that the present invention is most useful.

The cable 13 may be secured by a suitable means to collars 12, for example, by being welded or by being inserted through a ring on the outer surface of the collar 12. Preferably, however, the cable is attached in a manner as will be described below. Collars 12 are securely attached to the casing 11 by any suitable means, such as, for example, set screws 14 inserted through apertures in each collar 12, preferably equidistantly from each other.

Tubes 20, which have an inside diameter just slightly greater than the outside diameter of the cable, are slipped onto the cable, spaced at approximately uniform intervals along the cable, and are then crimped to an L-shape to secure them to the cable. The tubes 20 are placed in L-shaped cut-outs 21 in collars 12 (similarly, L-shaped cavities could be formed in collars 12) and are tack-welded into place. Collars 12 can then be quickly and easily attached to casing 11 using set screws 14. The spacing of collars 12 is determined by the diameter of the hole which cable 13 must frictionally contact; for example, collars 12 are spaced closer together on sections of casing 11 which are intended to be in the area of the bore hole 10 with a relatively large diameter due to brittleness and/or caving of the rock strata. The distance between each successive collar 12 is selected so that the cable 13 extends a sufficient distance outwardly from the casing 11 to scratch the wall of the bore 10 (see closer collar spacing on upper end of FIG. 1 for enlarged bore hole interval). As can be seen in FIG. 1, collars 12 are mounted on the casing 11 in such a way that tubes 20 are lined up one above the other so that cable 13 extends in a single longitudinal direction vertically along the casing 11.

For convenience in installing the well bore cleaning tool of the present invention on the casing 11, it should be constructed to cover an 8 to 10 feet section of casing using 5 or 6 equally spaced collars 14 each. These individual cleaning tools should be installed in plurality, end to end, on the casing joints which will span and adequately overlap all potential oil and/or gas zones where good cement bonding is required in the annulus between the casing 11 and the walls of the well bore, allowing only enough space on each casing joint for a centralizer, and the casing handling and make-up tools. The centralizers, which may be of any suitable known construction, are used to keep the casing 11 in the center of the hole 10. Casing 11, with the tool of the present invention attached thereto, is inserted into the hole 10 and, while cement is being pumped through the bottom of the casing, is rotated. It is preferable to install the well bore cleaning tool on the casing so that the open ends of tube 20 are on the leading edge of the casing during rotation. In that manner, the resistance of the cable to bend away from the casing adds to frictional force with which the cable segments 13 contact the walls of the well bore 10. This additional force helps to assure that all caked mud will be removed from the walls of the well bore 10 with rotation of the casing 11.

Although the cable segments of the tool of the present invention have been described as being preferably aligned substantially in a straight line along the casing, it should be understood that aligning the cable segments such that they make less than $\frac{1}{4}$ of a revolution around the casing would be an improvement over the devices known to the applicant; aligning the cable segments such that they make less than $\frac{1}{2}$, less than $\frac{3}{4}$, or less than 1 revolution around the casing is still superior to a tool in which the cable segments make a complete or more than one complete revolution around the casing.

In an actual trial operation of the preferred embodiment, it was found that having a single cable extending longitudinally along the side of the casing had many advantages, in contrast with any of the prior art device which include the spiraling cables or spiral brushes, etc. In particular, the longitudinally deployed cable had very little scarring effect on the bore hole wall during the lowering operation. Thus, the instant device is a safer device since it tends to dislodge much less of the wall cake or cause caving of rock strata while being deployed down the hole to the cementing location. Hence, there is less of a tendency for dislodged material to cause a constriction in the bore hole during this lowering operation.

Many changes and modifications in the above-described embodiment can be carried out without departing from the spirit or scope of the present invention. Accordingly, I pray that my rights to the present invention be limited only by the following claims.

I claim:

1. A well bore cleaning tool adapted for attachment to a casing pipe or the like which is to be run into a close tolerance well bore, said well bore cleaning tool comprising:

a single cable;

attaching means to attach the cable to the casing pipe at a plurality of axially spaced-apart locations for extending the cable in a single longitudinally vertical direction along the casing pipe, and wherein the cable makes less than one complete revolution around the casing, while the cable is adapted to frictionally contact a well bore wall during rotation of the casing; and wherein said attaching means comprises a plurality of successive axially spaced-apart collars, each provided with an L-shaped tubular insert through which the cable is placed in such a manner that the cable at its place of engagement with the tubular insert is positioned at an angle to its longitudinally vertical orientation, such that open ends of the tubular insert are on a leading edge of the casing during rotation of the casing, thereby facilitating frictional contact of the cable with a well bore wall.

2. The well bore cleaning tool as in claim 1, wherein the cable makes less than $\frac{3}{4}$ of a revolution around the casing.

3. The well bore cleaning tool as in claim 2, wherein the cable makes less than $\frac{1}{2}$ of a revolution around the casing.

4. The well bore cleaning tool as in claim 3, wherein the cable makes less than $\frac{1}{4}$ of a revolution around the casing.

5. The well bore cleaning tool as in claim 1, wherein the collars are securely attached to the casing.

6. A close tolerance well bore cleaning tool or rotary scratcher for attachment to a casing pipe or the like which is to be run into the well bore, comprising:

a plurality of axially spaced-apart successive collars;

means for selectively securing each collar to the exterior of the casing pipe;

a cable interconnecting each successive collar, the cable extending for placement in a single longitudinally vertical direction along the casing; and a plurality of L-shaped tubular inserts, each attached to its corresponding collar, the tubular insert receiving the cable therethrough, such that open ends of each tubular insert are on a leading edge of the casing during rotation of the casing and the cable at its place of engagement with the tubular insert is positioned at an angle to its longitudinally vertical orientation, thereby facilitating frictional contact of the cable with the well bore wall.

7. The tool of claim 6, wherein the successive collars are interconnected by a single cable that extends from one collar to a successive collar.

8. The tool of claim 7, wherein the L-shaped tubular inserts are substantially longitudinally aligned.

9. The tool of claim 8, wherein the means for selectively securing each collar to the casing is at least one set screw through the collar.

10. A close tolerance well bore cleaning tool or rotary scratcher for attachment to a casing pipe or the like which is to be run into the well bore, comprising:

a plurality of successive collars interconnected by a single cable that extends from a collar to a successive collar, the cable being secured to each collar by an attachment means, the attachment means comprising a tubular, L-shaped insert fixedly secured to the collar, the cable being placed through the tubular insert and the insert crimped to hold the cable, the cable extending in a single longitudinally vertical direction along the casing and the attachment means being longitudinally aligned, while the cable, at its place of engagement with the tubular insert, is positioned at an angle to its longitudinally vertical orientation and open ends of the tubular insert are on a leading edge of the casing during rotation of the casing, thereby facilitating frictional contact of the cable with the well bore wall; and a plurality of set screws through each collar for selectively securing the collar to the casing.

* * * * *